US009234283B2

(12) United States Patent
Bryden et al.

(10) Patent No.: US 9,234,283 B2
(45) Date of Patent: Jan. 12, 2016

(54) PROCESS FOR TREATING METAL SURFACES

(75) Inventors: Todd R. Bryden, Midland, MI (US); Jeng-Li Liang, Auburn Hills, MI (US); Jianping Liu, South Glastonbury, CT (US); John Zimmerman, Taylor, MI (US); Edis Kapic, Sterling Heights, MI (US); Bruce Goodreau, Romeo, MI (US)

(73) Assignee: Henkel AG & Co. KGaA, Duesseldorf (DE)

( * ) Notice: Subject to any disclaimer, the term of this patent is extended or adjusted under 35 U.S.C. 154(b) by 1302 days.

(21) Appl. No.: 12/029,729

(22) Filed: Feb. 12, 2008

(65) Prior Publication Data

US 2008/0280046 A1 Nov. 13, 2008

Related U.S. Application Data

(60) Provisional application No. 60/889,408, filed on Feb. 12, 2007.

(51) Int. Cl.

| | |
|---|---|
| ***C23C 22/06*** | (2006.01) |
| ***C23C 22/34*** | (2006.01) |
| ***C23C 22/50*** | (2006.01) |
| ***C23C 22/73*** | (2006.01) |

(52) U.S. Cl.

CPC ..... *C23C 22/34* (2013.01); *C23C 22/50* (2013.01); *C23C 22/73* (2013.01)

(58) Field of Classification Search

USPC ..... 427/327, 328, 435

See application file for complete search history.

(56) References Cited

U.S. PATENT DOCUMENTS

| | | | | |
|---|---|---|---|---|
| 2,835,616 | A * | 5/1958 | Rausch et al. | 148/252 |
| 3,041,215 | A | 6/1962 | Jenkins et al. | |
| 3,682,713 | A | 8/1972 | Ries et al. | |
| 3,964,936 | A | 6/1976 | Das | |
| 4,338,140 | A | 7/1982 | Reghi | |
| 4,938,838 | A * | 7/1990 | Dalin et al. | 216/86 |
| 5,043,022 | A | 8/1991 | Kosters et al. | |
| 5,281,282 | A | 1/1994 | Dolan et al. | |
| 5,356,490 | A | 10/1994 | Dolan et al. | |
| 5,427,632 | A | 6/1995 | Dolan | |
| 5,449,415 | A | 9/1995 | Dolan | |
| 5,534,082 | A | 7/1996 | Dollman et al. | |
| 5,769,967 | A | 6/1998 | Dolan | |
| 5,810,939 | A * | 9/1998 | Angel et al. | 134/2 |
| 5,843,240 | A * | 12/1998 | Pedrazzini et al. | 134/3 |
| 5,908,511 | A * | 6/1999 | Bianchi | 134/3 |
| 5,938,861 | A | 8/1999 | Inoue et al. | |
| 5,958,147 | A * | 9/1999 | Berglind et al. | 134/3 |
| 6,206,981 | B1 | 3/2001 | Jenkins | |
| 6,312,812 | B1 | 11/2001 | Hauser et al. | |
| 6,464,800 | B1 | 10/2002 | Carlson et al. | |
| 6,488,990 | B1 | 12/2002 | Wetterer et al. | |
| 6,524,403 | B1 | 2/2003 | Bartlett et al. | |
| 6,572,983 | B2 | 6/2003 | Shimakura et al. | |
| 6,709,528 | B1 * | 3/2004 | Grubb et al. | 134/3 |
| 6,749,694 | B2 | 6/2004 | Greene et al. | |
| 6,764,553 | B2 | 7/2004 | Dolan | |
| 6,767,413 | B2 | 7/2004 | Nishimura | |
| 6,805,756 | B2 | 10/2004 | Claffey et al. | |
| 6,835,460 | B2 | 12/2004 | Cuyler et al. | |
| 7,029,522 | B2 | 4/2006 | Matsui et al. | |
| 7,063,735 | B2 | 6/2006 | Fristad et al. | |
| 2001/0050029 | A1 | 12/2001 | Inbe et al. | |
| 2003/0121568 | A1 * | 7/2003 | Giordani et al. | 148/259 |
| 2003/0185990 | A1 | 10/2003 | Bittner et al. | |
| 2003/0230364 | A1 * | 12/2003 | Greene et al. | 148/256 |
| 2004/0009300 | A1 | 1/2004 | Shimakura et al. | |
| 2004/0022950 | A1 | 2/2004 | Jung et al. | |
| 2004/0054044 | A1 | 3/2004 | Bittner et al. | |
| 2004/0062873 | A1 | 4/2004 | Jung et al. | |
| 2004/0137246 | A1 * | 7/2004 | Fristad et al. | 428/469 |
| 2004/0144451 | A1 | 7/2004 | Matsukawa et al. | |
| 2004/0151619 | A1 * | 8/2004 | Quellhorst et al. | 422/14 |
| 2004/0163735 | A1 | 8/2004 | Matsukawa et al. | |
| 2004/0163736 | A1 | 8/2004 | Matsukawa et al. | |
| 2004/0170840 | A1 | 9/2004 | Matsukawa et al. | |
| 2004/0187967 | A1 * | 9/2004 | Matsukawa et al. | 148/247 |
| 2004/0217328 | A1 | 11/2004 | Matsui et al. | |
| 2005/0016634 | A1 * | 1/2005 | Giordani et al. | 148/241 |
| 2005/0020746 | A1 | 1/2005 | Fristad et al. | |
| 2006/0093755 | A1 | 5/2006 | Bittner et al. | |
| 2006/0147735 | A1 | 7/2006 | Matsukawa et al. | |
| 2006/0172064 | A1 | 8/2006 | Kolberg et al. | |
| 2006/0185769 | A1 * | 8/2006 | Nakayama et al. | 148/247 |

FOREIGN PATENT DOCUMENTS

| | | | |
|---|---|---|---|
| EP | 188975 | A * | 7/1986 |
| GB | 1242761 | A | 11/1971 |
| WO | WO 2004055237 | A1 * | 7/2004 |
| WO | 2006076197 | A1 | 7/2006 |
| WO | 2007113141 | A1 | 11/2007 |

OTHER PUBLICATIONS

Machine English Translation of EP 188975A.*

Written Opinion dated Jun. 24, 2008, International Application PCT/US2008/001799.

International Search Report dated Jun. 24, 2008. International Application PCT/US2008/001799.

European Search Report dated Jul. 18, 2011, European Application 08725429.8.

* cited by examiner

*Primary Examiner* — David Turocy

(74) *Attorney, Agent, or Firm* — Mary K. Cameron

(57) ABSTRACT

The corrosion resistance of a metal substrate surface treated with an acidic aqueous composition to form a conversion coating is improved by first contacting the surface with an oxidizing acidic pre-rinse, such as an aqueous solution of nitric acid and hydrogen peroxide, or nitric acid and hydrofluoric acid, or $Fe^{+3}$ cations and hydrofluoric acid.

24 Claims, No Drawings

PROCESS FOR TREATING METAL SURFACES

CROSS REFERENCE TO RELATED APPLICATION

This application claims priority from U.S. Provisional Application No. 60/889,408 filed Feb. 12, 2007.

FIELD OF THE INVENTION

This invention relates to processes for treating metal surfaces to render such surfaces more resistant to corrosion, particularly metal surfaces that are to be covered with a decorative and/or protective organic-based coating such as a paint. In particular, the invention pertains to a process where the metal surface is contacted with an oxidizing acidic pre-rinse prior to being treated with an aqueous composition containing a fluoroacid such as hexafluorozirconic acid and/or a partially neutralized derivative thereof.

DISCUSSION OF THE RELATED ART

A conversion coating is often applied to metal substrates, especially iron-containing metal substrates such as steel, prior to the application of a protective and/or decorative coating such as a paint. The conversion coating helps to reduce the amount of corrosion on the surface of the metal substrate when the coated metal substrate is exposed to water and oxygen. Many of the conventional conversion coatings are based on metal phosphates such as zinc phosphates and rely on chrome-containing rinses after a phosphating step to achieve maximum corrosion protection. Such conversion coating technology has the disadvantage, however, of generating waste streams that are potentially harmful to the environment and thus require expensive disposal or recycle procedures.

As a result, in recent years there has been a trend towards the use of alternative conversion coating technologies that avoid or reduce the problems associated with conventional systems. Many such conversion coating products are aqueous compositions based on fluoroacids such as hexafluorozirconic acid and hexafluorotitanic acid, often in combination with one or more other components. Examples of such products are described in U.S. Pat. No. 7,063,735 and U.S. Patent Publication Nos. 2005-0020746 and 2006-0172064, each of which is incorporated herein by reference in its entirety.

While the aforementioned alternative conversion coating products often function quite satisfactorily, in certain particularly demanding end-use applications (e.g., where the final coated metal substrate will be exposed to especially harsh environmental conditions) it would be desirable to further enhance or improve the corrosion resistance of the coated metal substrate.

BRIEF SUMMARY OF THE INVENTION

The invention provides a method of treating a surface of a metal substrate, such as by way of non-limiting example iron, steel, in particular cold rolled steel. The metal substrate surface is contacted with an oxidizing acidic pre-rinse and then with an aqueous coating composition comprised of ions of one or more elements selected from the group consisting of titanium, zirconium, hafnium, silicon, aluminum, tin, germanium and boron. Metal substrate surfaces that have been treated in this manner may be subsequently coated with an organic-containing composition such as a paint and are significantly more resistant to corrosion than surfaces that have not been treated with the oxidizing acidic pre-rinse.

Various embodiments of the method are provided wherein the oxidizing acidic pre-rinse is comprised of water and:

Fe+3 cations, and hydrofluoric acid;

Fe+3 cations, and fluoride anions;

Fe+3 cations, hydrogen peroxide and fluoride anions;

nitric acid and hydrofluoric acid;

at least one oxidant, and hydrofluoric acid;

nitric acid, and hydrogen peroxide.

Desirably, the oxidizing acidic pre-rinse has a pH of from about 1.5 to about 4.

It is a further object of the invention to provide a method wherein the pre-rinse has an oxidation-reduction potential of from about 200 to about 400 mV.

It is an object of the invention to provide a method of treating a surface of a metal substrate, the method comprising a) contacting the surface with an oxidizing acidic pre-rinse comprised of water and b) following step a), contacting the surface with an acidic aqueous coating composition comprised of ions of one or more elements selected from the group consisting of titanium, zirconium, hafnium, silicon, tin, germanium, aluminum and boron. Desirably, the acidic aqueous coating composition has a pH of from about 2.5 to about 6, preferably from about 3.5 to about 5.5.

It is a further object of the invention to provide a method wherein the acidic aqueous coating composition is comprised of one or more fluoroacids of one or more elements selected from the group consisting of titanium, zirconium, hafnium, silicon, aluminum and boron. It is a yet further object of the invention to provide a method wherein the one or more fluoroacids are complex metal fluorides of Ti, Zr, Hf, Si, Sn, Ge, Al or B. In one embodiment, the one or more fluoroacids are fluorocomplexes of Ti or Zr, and preferably comprise one or more fluoroacids selected from the group consisting of hexafluorozirconic acid, hexafluorotitanic acid and salts thereof.

It is a further object of the invention to provide a method wherein the acidic aqueous coating composition is prepared by partially neutralizing a solution of at least one fluoroacid selected from the group consisting of hexafluorozirconic acid and hexafluorotitanic acid with at least one base.

It is a further object of the invention to provide a method wherein the acidic aqueous coating composition is additionally comprised of at least one zinc species.

It is a further object of the invention to provide a method wherein the acidic aqueous coating composition has a Zr concentration of from about 10 to about 1500 mg/L.

It is a further object of the invention to provide a method wherein the acidic aqueous coating composition in step b) is maintained at a temperature of from about 10 degrees C. to about 40 degrees C. during the contacting.

It is a further object of the invention to provide a method wherein the acidic aqueous coating composition is additionally comprised of particles of at least one inorganic compound. It is a yet further object of the invention to provide a method wherein the acidic aqueous coating composition is additionally comprised of acid-stable particles of at least one inorganic compound. In one embodiment, the acidic aqueous coating composition is additionally comprised of particles of aluminum-modified silica.

It is a further object of the invention to provide a method wherein the acidic aqueous coating composition is additionally comprised of polymeric organic particles.

It is a yet further object of the invention to provide a method comprising an additional step after step b) of applying a resin-based coating or a layer of paint to the surface of the metal substrate.

DETAILED DESCRIPTION OF EMBODIMENTS OF THE INVENTION

The oxidizing acidic pre-rinse utilized in the process of the present invention is generally an aqueous composition containing a relatively strong acid, such as a mineral acid or combination of different mineral acids. Hydrofluoric acid and nitric acid are two acids particularly preferred for use in the present invention. To increase the oxidizing capacity of the oxidizing acidic pre-rinse to the desired level, it will generally be preferred to include one or more oxidants in the pre-rinse, especially where the acid used is not an oxidizing acid. For example, hydrofluoric acid (a non-oxidizing acid) is desirably used in combination with a peroxy species such as hydrogen peroxide, which acts as an oxidant. Nitric acid (an oxidizing acid) can be used by itself to prepare the oxidizing acidic pre-rinse or in combination with a non-oxidizing acid such as hydrofluoric acid or a peroxy species such as hydrogen peroxide, an organic hydroperoxide, an organic peroxide, a peroxyacid or salt thereof, a diacylperoxide, or a peroxyester. Other suitable oxidants that can be used in the oxidizing acidic pre-rinse include, for example, persulfuric acids and salts such as sodium persulfate or ammonium persulfate, perboric acid and salts thereof such as sodium perborate, nitrates such as sodium nitrate, potassium nitrate, Group II metal nitrates, titanium nitrate, perphosphoric acids and salts thereof, ferric salts such as ferric nitrate, ferric sulfate, ferric fluoride and the like.

In one embodiment of the invention, the oxidizing acidic pre-rinse comprises, consists essentially of, or consists of water, nitric acid and hydrofluoric acid. In this embodiment, the concentration of nitric acid typically is within the range of from about 0.005 to about 0.5 (e.g., about 0.01 to about 0.1) weight % and the concentration of hydrofluoric acid typically is within the range of from about 0.001 to about 0.2 (e.g., about 0.003 to about 0.05) weight %. Typically, the pH of the pre-rinse is within the range of from about 1 to 4 (e.g., about 2 to about 3).

In another embodiment of the invention, the oxidizing acidic pre-rinse comprises, consists essentially of, or consists of water, nitric acid and hydrogen peroxide. This type of pre-rinse has been found to be especially effective in improving corrosion resistance when used prior to a conversion coating step which employs an aqueous coating composition comprised of a complex fluoride of zirconium, zinc cations, and silica particles. In this embodiment, the concentration of nitric acid in the pre-rinse typically is within the range of from about 0.01 to about 0.5 (e.g., about 0.01 to about 0.1) weight % and the concentration of hydrogen peroxide typically is within the range of from about 0.001 to about 0.2 (e.g., about 0.01 to about 0.1) weight %. Typically, the pH of the pre-rinse is within the range of from about 1 to 4 (e.g., about 2 to about 3).

In still another embodiment of the invention, the oxidizing acidic pre-rinse comprises, consists essentially of, or consists of water, $Fe^{+3}$ cations and hydrofluoric acid. The $Fe^{+3}$ cations may be generated from any suitable source such as a ferric salt, in particular ferric fluoride. An oxidant such as a peroxy compound (e.g., hydrogen peroxide) may be employed to maintain the desired concentration of $Fe^{+3}$ cations. For example, the pre-rinse may comprise, consist essentially of, or consist of the following subcomponents (in addition to water):

(C.1) a total amount of fluoride ions, which may be simple or complex fluoride ions or both, that provides a concentration thereof in the pre-rinse of at least 0.4 g/L and not more than 5 g/L;

(C.2) an amount of dissolved trivalent iron atoms that is at least 0.1 g/L and not more than 5 g/L; and (C.3) a source of hydrogen ions in an amount sufficient to impart to the pre-rinse a pH that is at least 1.6 and not more than 5; and, optionally, (C.4) hydrogen peroxide.

It should be understood that subcomponents (C.1) through (C.3) need not all be derived from different materials. Hydrofluoric acid, in particular, is preferred as a source for both (C.1) and (C.3), and ferric fluoride can supply both (C.1) and (C.2).

The pre-rinse in this embodiment preferably has an oxidation potential, measured by the potential of a platinum or other inert metal electrode in contact with the pre-rinse, that is at least 150 mV more oxidizing than a standard hydrogen electrode (SHE) and independently preferably is not more than 550 mV more oxidizing than a SHE.

The oxidizing acidic pre-rinse used in the inventive process also contains water. Water is used to dilute the active components of the pre-rinse and thus acts as a carrier. Although the pre-rinses typically applied to the metal substrate in the process of the invention will contain a high proportion of water (e.g., about 95% by weight or greater), it is to be understood that such a pre-rinse can be prepared by diluting a concentrated formulation with the desired quantity of water. The end-user simply dilutes the concentrated formulation with additional water to obtain an optimal pre-rinse concentration for a particular coating application. If storage stability is an issue with a one part concentrated formulation, the pre-rinse can be provided in two parts, which are combined and diluted with water, or added separately to a selected amount of water, or diluted with water and combined. The pre-rinse can also be provided to the inventive process as a replenisher, e.g., where the pre-rinse is maintained as a bath within which successive metal substrates are immersed, a concentrated version of the pre-rinse may be periodically added to the bath to restore the concentrations of the active components to the desired levels as such active components become depleted through reaction with the metal substrates and/or drag-out.

The oxidizing acidic pre-rinse is contacted with the surface of the metal substrate to be treated for a time and at a temperature effective to improve the corrosion resistance of the final coated metal substrate to the desired extent. The optimum contacting conditions will vary depending upon a number of factors, including, for example, the concentrations and identities of the active components present in the pre-rinse, the pH of the pre-rinse, the type of metal in the substrate, as well as the composition of the aqueous coating composition to be used in the subsequent step of the process, but may be readily determined by routine experimentation. For the specific pre-rinse embodiments discussed previously herein, however, typically it will be suitable to contact the pre-rinse with the metal substrate surface for between about 1 second and 5 minutes (e.g., about 5 seconds to about 2 minutes) at a temperature of from about 10 to about 40 degrees C. (e.g., about room temperature). The pre-rinse may be applied to the metal substrate surface by any convenient method such as spraying, immersion (dipping), roller coating, etc. Excess pre-rinse may be removed from or allowed to drain from the metal substrate surface prior to proceeding with subsequent steps in the process. Although not necessary, the metal substrate surface may be dried before being subjected to further processing. Before being contacted with the aqueous coating composition, the pre-rinse-treated metal substrate surface can be washed or rinsed with water if so desired.

The aqueous coating composition utilized in the present invention may be any of the conversion coating compositions known in the art that contain ions of one or more elements selected from the group consisting of titanium, zirconium, hafnium, silicon, aluminum and boron. Fluoroacids of these elements are especially preferred as sources of such ions.

The term "fluoroacid" as used herein includes the acid fluorides and acid oxyfluorides containing one or more elements selected from the group consisting of Ti, Zr, Hf, Si, Sn, Al, Ge and B as well as salts of such compounds. The fluoroacid should be water-soluble or water-dispersible and preferably comprise at least 1 fluorine atom and at least one atom of an element selected from the group consisting of Ti, Zr, Hf, Si, Sn, Al, Ge or B. The fluoroacids are sometimes referred to by workers in the field as "fluorometallates".

Suitable fluoroacids can be defined by the following general empirical formula (I):

$$H_pT_qF_rO_s \quad (I)$$

wherein: each of q and r represents an integer from 1 to 10; each of p and s represents an integer from 0 to 10; T represents an element selected from the group consisting of Ti, Zr, Hf, Si, Sn, Al, Ge, and B. Preferred fluoroacids of empirical formula (I) include compounds where T is selected from Ti, Zr, or Si; p is 1 or 2; q is 1; r is 2, 3, 4, 5, or 6; ands is 0, 1, or 2.

One or more of the H atoms may be replaced by suitable cations such as ammonium, metal, alkaline earth metal or alkali metal cations (e.g., the fluoroacid can be in the form of a salt, provided such salt is water-soluble or water-dispersible). Examples of suitable fluoroacid salts include $(NH_4)_2ZrF_6$, $H(NH_4)ZrF_6$, $MgZrF_6$, $Na_2ZrF_6$ and $Li_2ZrF_6$. Such salts may be produced in situ in the aqueous coating composition by partial or full neutralization of an acid fluoride or acid oxyfluoride with a base (which can be organic or inorganic in character, e.g., ammonium bicarbonate, hydroxylamine).

The preferred fluoroacids used in the process of the invention are selected from the group consisting of fluorotitanic acid ($H_2TiF_6$), fluorozirconic acid ($H_2ZrF_6$), fluorosilicic acid ($H_2SiF_6$), fluoroboric acid ($HBF_4$), fluorostannic acid ($H_2SnF_6$), fluorogermanic acid ($H_2GeF_6$), fluorohafnic acid ($H_2HfF_6$), fluoroaluminic acid $H_3AlF_6$), and salts of each thereof. The more preferred fluoroacids are fluorotitanic acid, fluorozirconic acid, fluorosilicic acid, and salts of each thereof. Some of the salts that can be used include alkali metal and ammonium salts, e.g., $Na_2MF_6$, $HNaMF_6$, $H(NH_4)MF_6$ and $(NH_4)_2MF_6$, where M is Ti, Zr, or Si.

The aqueous coating composition may additionally contain one or more other components in addition to the fluoroacid(s). Such additional components may include, for example, inorganic particles, organic particles (e.g., polymeric particles), dissolved polymers, and the like as well as various other water-soluble or water-dispersible compounds or substances known in the art to enhance the corrosion resistance of the final treated metal substrate.

Compounds other than fluoroacids may also be used as sources of the ions of Zr, Ti, Hf, B, Si, Sn, Al, and/or Ge, such as the fluorides, chlorides, oxides, carbonates, oxyhalides, sulfates, and nitrates of such elements.

In one desirable embodiment of the invention, the aqueous coating composition contains at least one inorganic compound in particle form, the particles, for example, having an average particle diameter, measured under a scanning electron microscope, up to 1 micron in diameter or up to 0.2 microns in diameter or up to 0.05 microns in diameter. Such inorganic particles may be based, for example, on $Al_2O_3$ (alumina), $BaSO_4$, rare earth oxide(s), $SiO_2$ (silica), silicates, $TiO_2$ (titania), $Y_2O_3$, ZnO and/or $ZrO_2$ as well as mixed metal oxides and the like and surface-modified derivatives of such substances. Such particles may be in colloidal, dispersed or suspended form.

In certain embodiments of the invention, the aqueous coating composition may additionally one or more dissolved or dispersed species selected from nitrate ions, copper ions, silver ions, vanadium or vanadate ions, bismuth ions, magnesium ions, zinc ions, manganese ions, cobalt ions, nickel ions, free fluoride (i.e., fluoride not bound in complex form, such as in a fluoroacid), tin ions, aromatic carboxylic acids with at least two groups containing donor atoms, or derivatives of such carboxylic acids, chemical conversion reaction accelerators, and the like.

Especially suitable aqueous coating compositions include those described in U.S. Pat. No. 7,063,735 and U.S. Patent Publication Nos. 2005-0020746 and 2006-0172064, each of which is incorporated herein by reference in its entirety.

For example, the aqueous coating composition may comprise acid-stable particles and one or more fluoroacids. The composition can also or alternatively contain a product of the acid-stable particles and the one or more fluoroacids. Particles are acid-stable if the change in viscosity as measured in a test sample, as described in US Published Application 2006-0172064 under the subheading, "Test procedure for acid-stable particles", is ten seconds or less, preferably five seconds or less. In most cases, test samples that correspond to acid-stable particles particularly useful in the practice of the invention will have a change in viscosity of three seconds or less. In the most preferred embodiments, the acid-stable particles will have a change in viscosity of one second or less. Typically, the lower the change in viscosity the more stable the particles are in acid, that is, in an aqueous solution with a pH of less than 7.

The term "change in viscosity" used herein reflects the viscosity measurement made in accordance to the described test procedure. With respect to some of the acid-stable particle compositions useful in the present invention, their corresponding test samples can over 96 hours actually decrease in viscosity such that the measured change in viscosity is less than zero.

Alternatively, one of ordinary skill can determine if particles are acid-stable by preparing an acidified test sample containing the particles as described, and simply observing whether there is any visible indication of thickening, precipitation or gelling over about 96 hours at room temperature.

Typically, the acid-stable particles that can be used in practicing this particular embodiment of the invention will maintain a negative charge at a pH from about 2 to about 7. In some cases, the acid-stable particles will maintain a negative charge at a pH from about 3 to about 6. In still other cases, the acid-stable particles will maintain a negative charge at a pH from about 3.5 to about 5.

One way to determine whether the acid-stable particles retain a negative charge is by measuring the Zeta Potential of the particles. This measurement can be carried out using commercially available instruments such as a Zetasizer 3000HSA from Malvern Instruments Ltd. A negative measured voltage indicates the particles are negatively charged. Exemplary Zeta Potentials for silica-based, acid-stable particles useful in the aqueous coating compositions utilized in the process of the present invention are −5 to −35 mV. Exemplary Zeta Potentials for the organic, polymeric acid-stable particles that can be used in the aqueous coating compositions are −55 to −85 mV.

The aqueous coating compositions used in the inventive process also contain water. Water is used to dilute the aqueous coating composition and imparts relatively long-term stability to the composition. For example, a composition that contains less than about 40% by weight water is more likely to polymerize or "gel" compared to an aqueous coating composition with about 60% or greater by weight water under identical storage conditions. Although the aqueous coating compositions typically applied to the substrate in this embodiment of the invention will contain about 92% water or greater, it is to be understood that such a coating composition can be prepared by diluting a concentrated formulation composition with 60% to 92% by weight water. The end-user simply dilutes the concentrated formulation with additional water to obtain an optimal coating composition concentration for a particular coating application.

The aqueous coating composition should be acidic, i.e., have a pH of less than 7, preferably within the range of from about 1.5 to about 6.5, more preferably within the range of from about 2 to about 6. The pH may be adjusted as desired using one or more acids or bases, such pH-adjusting agents being selected such that they do not interfere with or adversely affect the desired conversion coating of the metal substrate surface. Certain pH-adjusting agents may actually have a beneficial effect on conversion coating, independent of the effect of controlling the pH. Examples of pH-adjusting agents include ammonium compounds such as ammonium bicarbonate and amines such as hydroxylamine.

The aqueous coating composition used in practicing the process of the invention can be provided as a ready-to-use coating composition, as a concentrated coating composition that is diluted with water prior to use, as a replenishing composition, or as a two component coating system. In a two-component coating system where the aqueous coating composition will contain both a fluoroacid and inorganic or organic particles, for example, the fluoroacid is stored separately from the particles. The fluoroacid and the particles are then mixed prior to use by the end-user.

The concentration of each of the respective components of the aqueous coating compositions will, of course, be dependent upon whether the coating composition to be used is a replenishing coating composition, a concentrated coating composition, or a ready-to-use coating composition. A replenishing coating composition can be provided to and used by an end-user to restore an optimal concentration of components of a coating composition to a coating bath as the components are consumed during the coating of substrates. As a result, a replenishing coating composition will necessarily have a higher concentration of acid-stable particles or fluoroacids than the coating composition used to coat the substrate.

The concentration of acid-stable particles in the aqueous coating compositions utilized in this particular embodiment of the invention depends on the type of particles used and the relative size, e.g., average diameter, of the particles. The coating compositions may, for example, contain from 0.005% to 8% by weight, 0.006% to 2% by weight, 0.007% to 0.5% by weight, or from 0.01% to 0.2% by weight, on a dry weight basis of acid-stable particles.

The inorganic particles can be relatively spherical in shape with an average diameter from about 2 nm to about 40 nm, preferably from about 2 nm to about 20 nm, as measured by transmission electron microscopy (TEM). The particles can also be rod-shaped with an average length from about 40 nm to about 300 nm, and an average diameter from about 5 nm to about 20 nm. The particles can be provided as a colloidal dispersion, e.g., as a mono-dispersion, i.e., the particles have a relatively narrow particle size distribution. Alternatively, the colloidal dispersion can be poly-dispersed, i.e., the particles have a relatively broad particle size distribution.

In one embodiment, the inorganic particles used in the aqueous coating composition are silica particles provided as a colloidal suspension from Grace Davison under the trademark Ludox®. The silica particles are in the form of discrete spheres suspended in a basic, aqueous medium. The medium can also contain a water-soluble polymer to improve stability of the colloidal suspension. The water-soluble polymer can be one of the listed polymers provided below.

Preferred silica particles used to prepare the aqueous coating compositions used in the invention are what are known as acid-stable silica particles. Acid-stable silica particles can be alumina-modified silica. Alumina-modified silica generally will have a weight ratio of $SiO_2$:$Al_2O_3$ from about 80:1 to 240:1, preferably from about 120:1 to 220:1, more preferably from 160:1 to 200:1.

Preferred acid-stable silicas used to prepare the coating compositions of the invention include Ludox® AM and Ludox® TMA. Ludox® AM has a weight ratio of $SiO_2$:$Al_2O_3$ from about 160:1 to 200:1. Other types of Ludox® silica particles that can be used to prepare an aqueous coating composition useful in practicing the invention include Ludox® SK-G and Ludox® SK. Ludox® SK has an average particle diameter of about 12 nm, and Ludox®M SK-G has an average particle diameter of about 7 nm. Both commercial forms of colloidal silica contain a polyvinyl alcohol polymer, which is used to stabilize the colloids.

In other embodiments, silica particles used in the aqueous coating compositions are obtained as a colloidal suspension from Nissan Chemical under the trademark Snowtex®. In particular, Snowtex® O, Snowtex® XS, and Snowtex® C can be used to prepare aqueous coating compositions suitable for practicing the invention. Snowtex®-OUP, which contains rod-like silica particles, can also be used. Fumed silica as well as aluminum-modified silica such as Adelite® AT-20A obtained from Asahi Denka can also be used.

In another embodiment, organic, polymeric acid-stable particles can be used in the aqueous coating compositions. For example, polymeric particles selected from the group consisting of anionically stabilized polymer dispersions, such as epoxy-crosslinked particles, epoxy-acrylic hybrid particles, acrylic polymer particles, polyvinylidene chloride particles (including copolymers of vinylidene chloride with one or more other types of comonomers), and vinyl acrylic/vinylidene chloride/acrylic particles provide acid-stable coating compositions. Three commercially available polymeric particles that can be used include ACC® 800 and ACC® 900 series of Autophoretic® coating chemicals from Henkel Corporation, and Haloflex® 202 from Avecia, Inc. The ACC® 900 series products include epoxy resin-based particles. The ACC 800® series products include vinylidene chloride copolymer particles. Haloflex® 202 includes vinyl acrylic/vinylidene chloride/acrylic particles. The concentration of organic polymeric particles in the aqueous coating compositions used in the process of the invention may be, for example, from 0.01% to 8% by weight, from 0.01% to 5% by weight, or from 0.1% to 3% by weight, on a dry weight basis.

The aqueous coating compositions utilized in the inventive process can also include one or more polymers, although the presence of any type of polymer is optional (i.e., in certain embodiments, the aqueous coating composition is free or essentially free of polymer, e.g., the composition contains less than 1 mg/L polymer). The one or more polymers preferably comprise functional groups selected from hydroxyl, carboxylic acid/carboxylate, phosphonic/phosphonate, ester, amide, amine, sulfonic/sulfonate or combinations thereof. The functional groups on the polymers are believed to serve various functions. First, prior to forming the coatings, the functional groups provide a polymer that has a relatively high solubility or miscibility in water. Second, the functional groups provide points along the polymer backbone through which cross-linking between the polymers can occur as the coating composition cures to form a coating on a metal substrate. Third, the functional groups on the polymer are believed to enhance binding between the metal substrate and particles in the cured coating.

An exemplary list of the one or more polymers that can be used includes polyvinyl alcohols, polyesters, water-soluble polyester derivatives, polyvinylpyrrolidones, polyvinylpyrrolidone-vinylcaprolactam copolymers, polyvinylpyrrolidone-vinylimidazole copolymers, and sulfonated polystyrene-maleic anhydride copolymers. The most preferred polymers used include polyvinyl alcohols and polyvinylpyrrolidone-vinylcaprolactam copolymers. Polymers sold under the brand names Luvitec® and Elvanol® are two commercially available types of polymers that can be used to prepare an aqueous coating composition suitable for use in the invention. Luvitec® polymers are vinylpyrrolidone-vinylcaprolactam polymers available from BASF. Elvanol® polymers are polyvinyl alcohol polymers available from Dupont.

Other suitable types of polymers that can be present in the aqueous coating composition include a) polymers or copolymers of allylamine, b) polymers or copolymers of vinylamine, c) polymers or copolymers of unsaturated alcohols or the esters or ethers thereof, d) polymers or copolymers of unsaturated carboxylic acids, organophosphonic acids, organophosphinic acids or in each case the salts, esters or amides thereof, e) polyamino acids or proteins or in each case the salts, esters or amides thereof, f) carbohydrates or the esters or ethers thereof, g) polyamines, in which the nitrogen atoms are incorporated into the polymer chain, h) polyethers, i) polyvinylphenols and the substitution products thereof, j) epoxy resins, k) amino resins, l) tannins, and m) phenol-formaldehyde resins.

Other types of aqueous coating compositions that can be adapted for use in the present invention include the formulations described in the following patents and published applications, each of which is incorporated herein by reference in its entirety: U.S. Pat. No. 3,682,713; U.S. Pat. No. 3,964,936; US 2004-0009300; US 2004-0054044; US 2004-0187967; US 2006-0147735; US 2004-0144451; U.S. Pat. No. 6,572,983; U.S. Pat. No. 6,767,413; U.S. Pat. No. 4,338,140; U.S. Pat. No. 5,281,282; U.S. Pat. No. 6,524,403; U.S. Pat. No. 5,356,490; U.S. Pat. No. 5,427,632; U.S. Pat. No. 5,449,415; U.S. Pat. No. 5,534,082; U.S. Pat. No. 5,769,967; U.S. Pat. No. 5,938,861; U.S. Pat. No. 6,464,800; U.S. Pat. No. 6,764,553; U.S. Pat. No. 6,312,812; US 2004-0022950; US 2004-0062873; U.S. Pat. No. 6,805,756; U.S. Pat. No. 6,749,694; U.S. Pat. No. 6,488,990; U.S. Pat. No. 7,029,522; US 2004-0163736; US 2004-0170840; US 2004-0163735; US 2004-014445; US 2001-0050029; and US 2004-0217328.

Aqueous coating compositions suitable for use in the process of the present invention are also available from commercial sources, such as, for example, Bonderite® NT-1 conversion coating (Henkel Corporation, Madison Heights, Mich.).

Metal substrates that can be treated in accordance with the process of the present invention to improve their corrosion resistance include any of the pure or alloyed metallic materials known in the art, particularly iron-containing substrates such as steel (e.g., cold rolled steel, hot rolled steel, alloy steel, carbon steel). Other suitable metal substrates include stainless steel, steel coated with zinc metal, Galvalume®-coated steel, Galvanneal™, hot-dipped galvanized steel, electro-galvanized steel, aluminum alloys and aluminum-plated steel.

The metal substrate can take any form, including, for example, wire, wire mesh, sheets, strips, panels, shields, vehicle components, casings, covers, furniture components, aircraft components, appliance components, profiles, moldings, pipes, frames, tool components, bolts, nuts, screws, springs or the like. The metal substrate can contain a single type of metal or different types of metal joined or fastened together in some manner. The substrate to be treated in accordance with the process of the present invention may contain metallic portions in combination with portions that are non-metallic, such as plastic, resin, glass or ceramic portions.

Although not necessary, the metal substrate can be cleaned prior to contacting with the oxidizing acidic pre-rinse to remove grease, dirt and other contaminants on the surface of the substrate. Conventional cleaning procedures and materials may be employed, such as, for example, mechanical methods such as shot or sand blasting as well as mild or strong alkaline cleaners and/or solvents. The metal substrate can then, if desired, be rinsed with water before being treated with the oxidizing acidic pre-rinse.

Both the oxidizing acidic pre-rinse and the aqueous coating composition may be brought into successive contact with the surface of the metal substrate using any of the methods known in the metal surface treatment art. Two preferred methods include spraying and immersion (i.e., dipping in a bath or tank), but other methods include rolling, flowcoating, knife-coating, and brushing.

Following contact of the metal substrate surface with the aqueous coating composition to form a conversion coating, the metal substrate may be subjected to one or more additional processing steps. For example, excess aqueous coating composition may be removed from the metal substrate surface by draining, wiping, or the like or dried in place (either under ambient conditions or with application of external heat). The metal substrate may also be rinsed (e.g., with water), optionally followed by drying. In one embodiment of the invention, one or more layers of paint are applied to the treated metal substrate. In the context of this invention, "paint" includes any of the known types of decorative and/or protective finishes containing one or more types of polymers or resins (thermoplastic as well as thermosettable or curable), such as for example, electrocoat finishes ("e-coat"), cationic electrodeposition coatings, anionic electrodeposition coatings, electrostatic spray coatings, solvent-borne paints, water-borne paints, primers, clear coat finishes, varnishes, radiation-curable coatings, and the like.

The process of the present invention may be carried in a batch, semi-continuous or continuous manner, with automation and/or process control being utilized as desired to reduce labor costs and enhance the quality and consistency of the treated metal substrate obtained thereby. Where the oxidizing acidic pre-rinse and the aqueous coating composition are maintained as baths with the metal substrates being immersed successively in those baths, the contents of the baths may be monitored continuously or periodically and replenishing amounts of the various components thereof may be added as needed. Similarly, if a bath accumulates undesirable levels of contaminants or materials that interfere with the performance or characteristics of the treated metal substrates produced by the process, the bath may be recycled or otherwise treated to remove or reduce the concentration of such contaminants or interfering materials.

A metal substrate treated in accordance with the process of the present operation may be further processed by forming, drawing, shaping, welding, adhesive joining/bonding, lamination, mechanical fastening, or the like, either by itself or in combination with one or more other substrates.

Examples 1-3

These examples demonstrate the improvements in corrosion protection that can be realized by practice of the present invention, wherein a metal substrate to be painted is contacted with an oxidizing acidic pre-rinse prior to pretreatment with an aqueous coating composition containing a fluoroacid. The metal substrates used were panels of cold rolled steel (CRS). In Example 1, no pre-rinse was employed prior to contacting the panel for 60 seconds at room temperature to an aqueous coating composition containing 1000 mg/L hexafluorozirconic acid (pH=2). Example 2 was identical to Example 1, except that the aqueous composition was first partially neutralized with hydroxylamine to a pH of 4. Example 3 was identical to Example 2, except that (in accordance with the present invention) the panel was contacted for 15 seconds with an oxidizing acidic pre-rinse before being contacted with the partially neutralized fluoroacid-containing aqueous coating composition. The oxidizing acidic pre-rinse initially contained, in addition to water, ferric fluoride (Fe concentration=1870 ppm) and hydrofluoric acid (free F concentration=2330 ppm; total F concentration=2440 ppm). Hydrogen peroxide was added to control the oxidation state of the iron such that predominately $Fe^{+3}$ was present (LineGuard® 101 meter reading=190 mA; Oxidation-Reduction Potential=300 mV). After treatment with the fluoroacid-containing aqueous composition, the panels were blown dry with compressed air prior to painting with a single coat of DURACRON 200 paint (a high solids, solvent-borne paint). The painted panels were then subjected to 504 hours of exposure to neutral salt spray and the scribe creep measured, as shown in Table 1.

TABLE 1

| Example | Oxidizing Acidic Pre-rinse? | Scribe Creep, mm |
|---|---|---|
| 1 (Comparative) | No | 11.6 |
| 2 (Comparative) | No | 3.5 |
| 3 (Invention) | Yes | 0.5 |

Although improvement in corrosion resistance is realized by partially neutralizing the hexafluorozirconic acid (compare Example 2 with Example 1), still further improvement is attained when the metal substrate is first contacted with an oxidizing acidic pre-rinse containing water, $Fe^{+3}$, and HF (compare Example 3 with Example 2).

Examples 4-5

These examples demonstrate the improvements in corrosion protection that can be realized by practice of the present invention, wherein a metal substrate to be painted is contacted with an oxidizing acidic pre-rinse containing hydrogen peroxide and nitric acid prior to pretreatment with an aqueous composition containing a fluoroacid. In Example 4 (Comparative), no pre-rinse was employed prior to contacting the cold rolled steel panel for 90 seconds to an aqueous composition containing Zr (derived from hexafluorozirconic acid and acid-stable silica in accordance with U.S. Published Application No. 2005/0020746), further modified with Zn ions (derived from zinc nitrate) in accordance with U.S. Published Application No. 2004/0187967. Example 5 was identical to Example 4, except that (in accordance with the present invention) the panel was contacted for 30 seconds with an oxidizing acidic pre-rinse before being contacted with the aqueous composition. The oxidizing acidic pre-rinse contained 0.06% nitric acid and 0.05% hydrogen peroxide and had a pH of 2.5. The treated panels were painted with CORMAX 6 e-coat (E.I. duPont de Nemours) and then subjected to 504 hours of exposure to neutral salt spray as well as 15 cycle APGE testing before measuring the scribe creep, as recorded in Table 2. The Zr coating weight on the panels was also measured.

TABLE 2

| | 504 Hr Salt Spray, scribe creep in mm | 15 Cycle APGE, scribe creep in mm | 30 Cycle GM9540P, scribe creep in mm | Zr Coating Weight, $mg/m^2$ |
|---|---|---|---|---|
| Example 4 (Comparative) | 4.3 | 16.5 | 6.6 | 21 |
| Example 5 (Invention) | 2.2 | 3.6 | 6.7 | 59 |

Examples 6-7

These Examples demonstrate the effectiveness of an oxidizing acidic pre-rinse containing nitric acid and hydrofluoric acid in improving the corrosion resistance of a metal substrate surface having a Zr-containing conversion coating formed thereon.

In Example 6 (Comparative), cold rolled steel panels were treated in accordance with the following multi-step process:

1. Cleaned with an alkaline cleaner (mixture of Parco® Cleaners 1523R, 1523A, and 1523S, 0.5%, 0.5%, and 0.13% concentrations respectively) applied by spraying (130 degrees F., 2 minutes).
2. Rinsed twice with tap water, applied by spraying (room temperature, 45 seconds).
3. Treated with an acidic aqueous coating composition containing Zr (from hexafluorozirconic acid) and acid-stable silica in accordance with U.S. Published Application 2005/0020746, applied by immersion (80 degrees F., 1 minute).
4. Rinsed twice with deionized water, applied by spraying (room temperature, 30 seconds).
5. Coated with BASF CATHOGUARD 310B e-coat, applied by immersion (90 degrees F., 2 minutes, 200 V)
6. Rinsed with deionized water, applied by spraying.
7. Cured in oven at 350 degrees F. for 20 minutes (0.6-1.0 mil coating thickness).

In Example 7 (Invention), Example 6 was repeated, except that the panels were immersed in an oxidizing acidic pre-rinse (room temperature, 30 seconds) between Steps 2 and 3. The pre-rinse contained 0.035 volume % nitric acid and 0.01 volume % hydrofluoric acid and had a pH of 2.5.

The coated panels were evaluated using the GM 9540P test procedure (40 cycles, maximum creep measured in mm), as shown in Table 3.

TABLE 3

| | Test Panel 1 | Test Panel 2 | Test Panel 3 |
|---|---|---|---|
| Example 6 (Comparative) | 8.3 | 9.1 | 8.6 |
| Example 7 (Invention) | 6.5 | 6.1 | 4.9 |

These results show that the use of an oxidizing acidic pre-rinse consistently enhances the corrosion resistance of the metal substrate surface.

What is claimed is:

1. A method of treating a surface of a metal substrate, said method comprising a) contacting said surface for a total time between about 1 second and about 2 minutes with an oxidizing acidic pre-rinse comprised of water and components:

1) a total amount of fluoride ions, which may be simple or complex fluoride ions or both, that provides a concentration thereof in the pre-rinse of at least 0.4 g/L and not more than 5 g/L;

2) an amount of dissolved trivalent iron atoms that is at least 0.1 g/L and not more than 5 g/L;

3) a source of hydrogen ions in an amount sufficient to impart to the pre-rinse a pH that is at least 1.6 and not more than 5; and optionally 4) hydrogen peroxide;

wherein component 3) the source of hydrogen ions consists of HF; at least a portion of component 1) is sourced from HF; and the pre-rinse has an oxidation potential that is at least 150 mV more oxidizing than a standard hydrogen electrode and not more than 550 mV more oxidizing than the standard hydrogen electrode;

and b) following step a), contacting said surface with an acidic aqueous coating composition comprised of ions of one or more elements selected from the group consisting of titanium, zirconium, hafnium, silicon, tin, germanium, aluminum and boron.

2. The method of claim 1, wherein said acidic aqueous coating composition is comprised of one or more fluoroacids of one or more elements selected from the group consisting of titanium, zirconium, hafnium, silicon, aluminum and boron.

3. The method of claim 2, wherein said one or more fluoroacids are complex metal fluorides of Ti, Zr, Hf, Si, Al or B; and the acidic aqueous coating composition further comprises one or more dissolved or dispersed species selected from nitrate ions, copper ions, silver ions, vanadium or vanadate ions, bismuth ions, magnesium ions, zinc ions, manganese ions, and cobalt ions.

4. The method of claim 2, wherein said one or more fluoroacids are fluorocomplexes of Ti or Zr.

5. The method of claim 2, wherein said one or more fluoroacids are selected from the group consisting of hexafluorozirconic acid, hexafluorotitanic acid and salts thereof.

6. The method of claim 1, wherein said acidic aqueous coating composition is prepared by partially neutralizing a solution of at least one fluoroacid selected from the group consisting of hexafluorozirconic acid and hexafluorotitanic acid with at least one base.

7. The method of claim 1, wherein said acidic aqueous coating composition has a pH of from about 2.5 to about 6.

8. The method of claim 1, wherein said oxidizing acidic pre-rinse consists of water, $Fe^{+3}$ cations in an amount of 0.1 g/L to 1.870 g/L, and hydrofluoric acid.

9. The method of claim 1, wherein said metal substrate is comprised of an iron-containing substrate.

10. The method of claim 1, wherein said metal substrate is comprised of steel.

11. The method of claim 1, wherein said acidic aqueous coating composition is additionally comprised of at least one zinc species.

12. The method of claim 1, wherein said acidic aqueous coating composition has a Zr concentration of from about 10 to about 1500 mg/L.

13. The method of claim 1, wherein said acidic aqueous coating composition in step b) is maintained at a temperature of from about 10 degrees C. to about 40 degrees C. during said contacting.

14. The method of claim 1, comprising an additional step after step b) of applying a resin-based coating to said surface of said metal substrate.

15. The method of claim 1, comprising an additional step after step b) of applying a layer of paint to said surface of said metal substrate.

16. The method of claim 1, wherein said acidic aqueous coating composition is additionally comprised of particles of at least one inorganic compound.

17. The method of claim 1, wherein said acidic aqueous coating composition is additionally comprised of acid-stable particles of at least one inorganic compound.

18. The method of claim 1, wherein said acidic aqueous coating composition is additionally comprised of particles of aluminum-modified silica.

19. The method of claim 1, wherein said acidic aqueous coating composition is additionally comprised of polymeric organic particles.

20. A method of treating a surface of a metal substrate, said method comprising:

a) contacting said surface for a time between about 1 second and about 2 minutes with an oxidizing acidic pre-rinse consisting of water, 1) about 0.005 to about 0.01 wt % nitric acid, and 2) hydrofluoric acid or a peroxy species; and b) following step a), contacting said surface with an acidic aqueous coating composition comprised of ions of one or more elements selected from the group consisting of titanium, zirconium, hafnium, silicon, tin, germanium, aluminum and boron.

21. The method of claim 20, wherein 2) is present as the peroxy species and is selected from hydrogen peroxide, an organic hydroperoxide, an organic peroxide, a peroxyacid, a salt of a peroxyacid, a diacylperoxide, and a peroxyester.

22. The method of claim 20, wherein 2) is present as the hydrofluoric acid in an amount of 0.001 to 0.2 wt. %.

23. A method of treating a surface of a metal substrate, said method comprising:

a) contacting said surface for a total time between about 1 second and about 2 minutes with an oxidizing acidic pre-rinse having a pH of about 1 to about 4, consisting of water, 1) about 0.005 to 0.06 wt % nitric acid, and 2) about 0.001 to about 0.2 wt % of a peroxy species; and b) following step a), contacting said surface with an acidic aqueous coating composition comprised of ions of one or more elements selected from the group consisting of titanium, zirconium, hafnium, silicon, tin, germanium, aluminum and boron, zinc cations, and silica particles.

24. A method of treating a surface of a metal substrate, said method comprising a) contacting said surface for a total time between about 1 second and about 2 minutes with an oxidizing acidic pre-rinse consisting of:

water and 1) a total amount of fluoride ions, which may be simple or complex fluoride ions or both, that provides a concentration thereof in the pre-rinse of at least 0.4 g/L and not more than 5 g/L;

2) an amount of dissolved trivalent iron atoms that is at least 0.1 g/L and not more than 5 g/L;

3) a source of hydrogen ions in an amount sufficient to impart to the pre-rinse a pH that is at least 1.6 and not more than 5; and optionally 4) hydrogen peroxide;

wherein component 3) the source of hydrogen ions consists of HF; at least a portion of component 1) is sourced from HF; and the pre-rinse has an oxidation potential that is at least 150 mV more oxidizing than a standard hydrogen electrode and not more than 550 mV more oxidizing than the standard hydrogen electrode;

and b) following step a), contacting said surface with an acidic aqueous coating composition comprised of ions of one or more elements selected from the group consisting of titanium, zirconium, hafnium, silicon, tin, germanium, aluminum and boron.

* * * * *